US005110155A

United States Patent [19]

Piechocki et al.

[11] Patent Number: 5,110,155

[45] Date of Patent: May 5, 1992

[54] GREETING CARD WITH INTERLOCKING PULLOUT

[75] Inventors: Edward Piechocki, Strocks Grove Rd., R.D. 1, Upper Black Eddy, Pa. 18972; Eric Liddell, Lititz, Pa.

[73] Assignee: Edward Piechocki, Upper Black Eddy, Pa.

[21] Appl. No.: 690,354

[22] Filed: Apr. 24, 1991

[51] Int. Cl.[5] ..... B42D 15/00

[52] U.S. Cl. ..... 283/117; 446/147; 446/151

[58] Field of Search ..... 446/151, 147, 149; 283/117

[56] References Cited

U.S. PATENT DOCUMENTS

| | | | |
|---|---|---|---|
| 1,699,383 | 1/1929 | Taylor | 446/151 |
| 2,554,098 | 5/1951 | Eisner | 446/151 |
| 2,884,724 | 5/1959 | Lohnes et al. | 446/151 |

*Primary Examiner*—P. W. Echols
*Assistant Examiner*—Willmon Fridie, Jr.
*Attorney, Agent, or Firm*—Gregory J. Gore

[57] ABSTRACT

A card construction includes an envelope portion of a card in the form of a sleeve or pocket with an opening at the top which receives and holds a slideable pullout. A tab is formed by a reverse fold at the lower end of the pullout. The rear face of the envelope includes an aperture or window which engages a tab extending from the lower end of the pullout. The location and dimension of the window corresponds to the tab so that the two engage at a point where it is appropriate to stop the pullout from coming any farther out of the envelope. Because of the outward spring force of the tab, a tapered end of the tab is thrust out of the window as it passes by the aperture, thus ensuring engagement between the pullout and the envelope.

8 Claims, 2 Drawing Sheets

FIG. 3
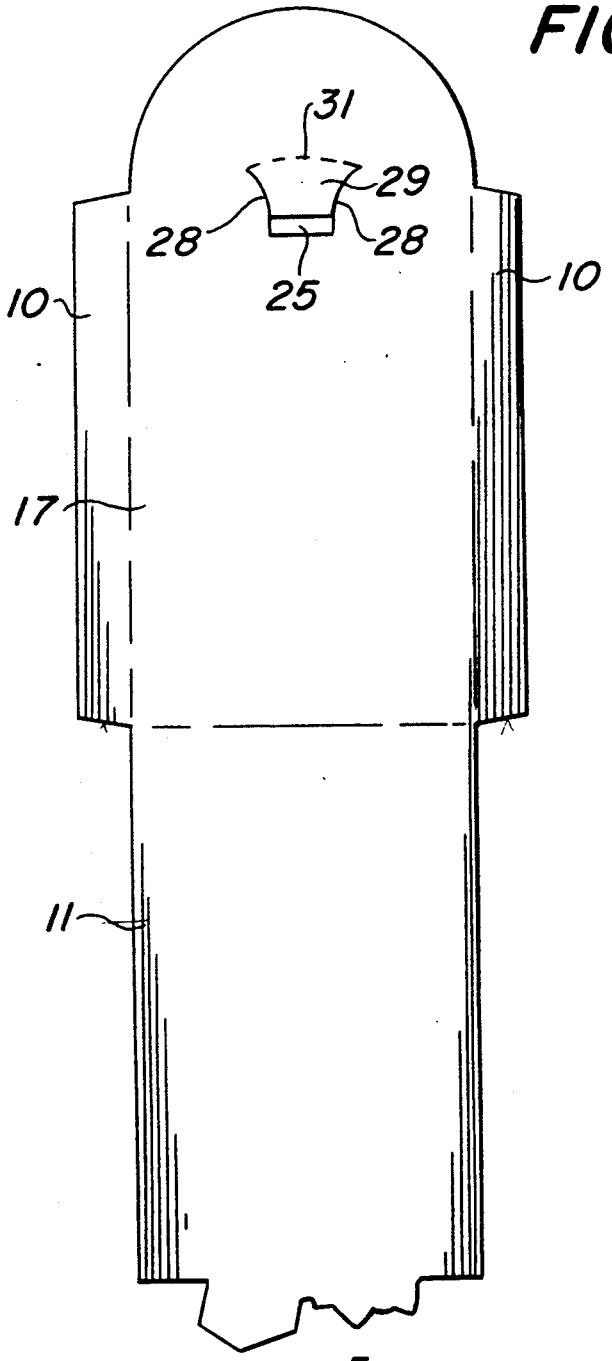
FIG. 4
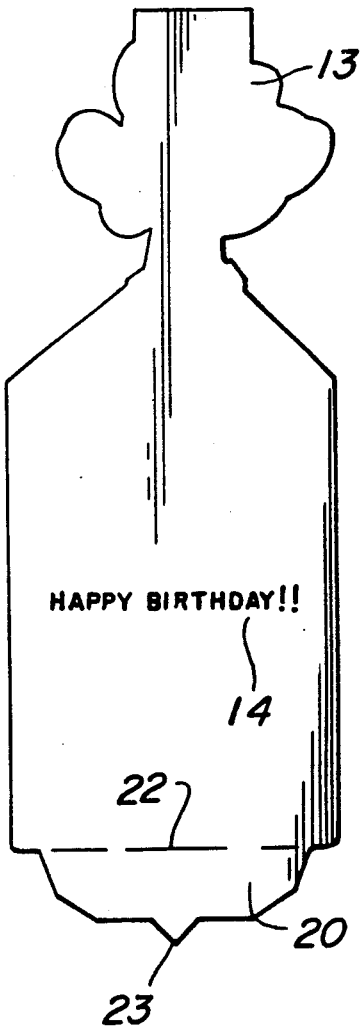
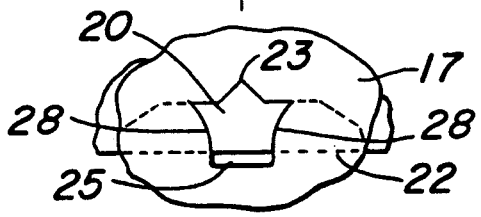
FIG. 6 5

GREETING CARD WITH INTERLOCKING PULLOUT

FIELD OF THE INVENTION

This device relates to greeting cards and, more specifically, to the type which have movable and interlocking parts.

BACKGROUND OF THE INVENTION AND PRIOR ART

It is well-known in the greeting card art to provide cards with movable and other dynamic structures which provide entertainment and amusement to the card. These cards contain notches, tabs and slots for permitting the movement between paper or cardboard components. This type of card construction is also known in other forms, such as calendars, information cards, and other card-type print media used for advertising. A significant problem with card construction which utilizes moving parts is the complexity of manufacture and assembly. Often, there is a great deal of manual labor required to assemble the parts. Interrelated slots and tabs must be hand-fitted or other separate elements must be attached after the assembly is complete in order to keep the individual parts from separating. Furthermore, disassembly usually requires destruction of one or more of the parts.

SUMMARY OF THE INVENTION

In order to overcome the problems in the art described above, a novel card construction has been devised. This construction includes a tab and window engagement which, by other relations described herein, permit a slideable card pullout insert to be fitted within the card body and to thereafter remain interlocked with the card without the need for any additional assembly or modification of these two card elements. The present device includes an envelope portion of card in the form of a sleeve or pocket with an opening at the top which receives and holds a slideable pullout. A tab is formed by a reverse fold at the lower end of the pullout. Because the free distance between the end of the tab and the main portion of the pullout is greater than the inside width of the envelope, an outward spring force of the tab against the inside of the envelope is provided by the reverse fold. This is due to the natural resilience of the material employed, which may be stiff, coated cardboard. The rear face of the envelope includes an aperture or window which engages a tab extending from the lower end of the pullout. The location and dimension of the window corresponds to the tab so that the two engage at a point where it is appropriate to stop the pullout from coming any farther out of the envelope. Because of the outward spring force of the tab, a tapered end of the tab is thrust out of the window as it passes the aperture, thus ensuring engagement between the pullout and the envelope.

The window may further include a tang which projects downward and may be formed in the material of the rear face of the envelope by dye cutting simultaneous with cutting the window aperture. The end of the tang lies along the top edge of the window and, thus, is the point of engagement of the window aperture with the tab. After its engagement with the tab, the tang becomes displaced inward toward the front face of the envelope thereby forming an inward projecting catch ensuring consistency of engagement with the tab. Also, there is created a wedging effect between the end of the tang and the inside of the tab fold which adds strength to the interlocking of the two elements. By these relations, the two main elements of the card may be interlocked by a simple insertion of the pullout into the envelope portion of the card. Thereafter, the two components remain slideably engaged, but permanently interlocked without the need for additional adhesives or any other fastening element.

An added advantage of this construction is that the two parts may be disengaged simply by separating the tang and tab. This construction permits a card having movable elements which may be completely machine assembled and constructed with a minimum of die cutting and adhesives. Other advantages will be apparent from the following drawings and description of the preferred embodiment of the invention.

BRIEF DESCRIPTION OF THE DRAWINGS

FIG. 3 is a rear view of the envelope portion of the present invention showing its pattern prior to folding and assembly.

FIG. 4 is front view of the pullout prior to folding and assembly.

FIG. 6 is an alternate rear view of the window area of FIG. 2 showing the tab and the tang engagement with the pullout in its fully extended position.

DESCRIPTION OF THE PREFERRED EMBODIMENT

Figure 1:
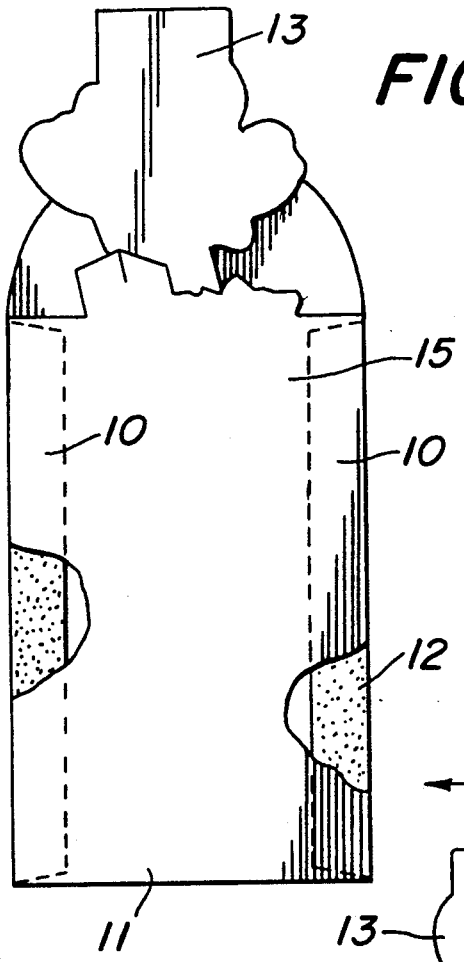
FIG. 1 is a front view of the present invention with the pullout located in its fully inserted position.

FIG. 1 of the present invention shows the present greeting card in its assembled condition. Pullout 13 is positioned within envelope 11. The envelope is constructed by folding over side portions 10 and sealing the side portions to the front face 15 with a suitable adhesive 12.

Figure 2:
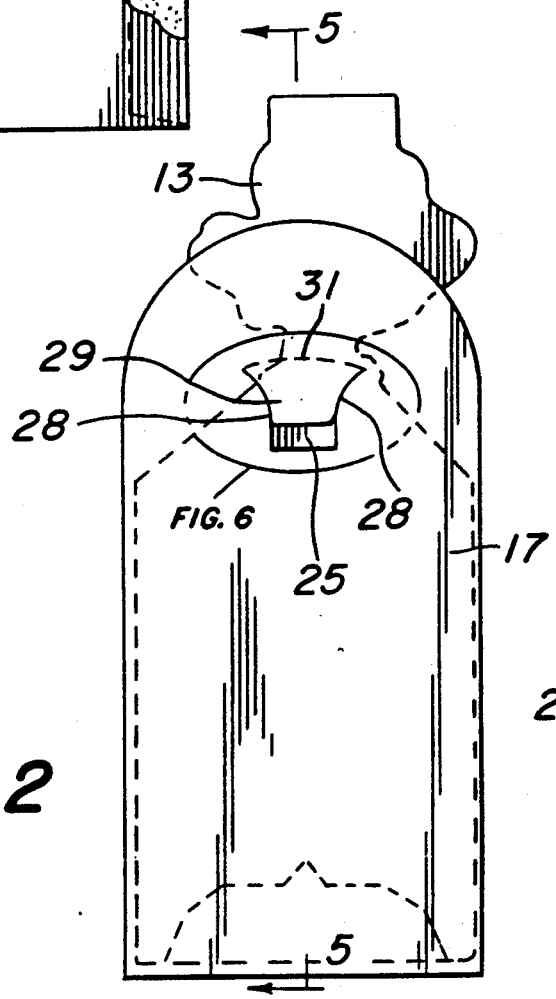
FIG. 2 is a rear view of the present invention.

Referring now to FIG. 2, the rear face of the card 17 includes window 25 and tang 29 which extends downward to form the top of the window from a fold line 31. As more clearly shown in FIG. 3, the tang and window are created by die-cutting into the unfolded pattern of the envelope portion of the card. The window 25 and tang 29 are formed at the same time and extended side cuts 28 through the material of the rear face 17 form the tang 29 which will be free to bend at fold line 31. In this embodiment, side flaps 10 are folded over the front face portion 11 to form the envelope structure as described above in referring to FIG. 1. FIG. 4 shows the die cut blank of pullout 13, including a message 14 or other information which is exposed as the pullout is removed from the envelope. A tab portion 20 extends from the bottom. During assembly, the tab will be folded along line 22 creating a reverse fold so that tab 20 will thereafter extend in the upward direction. The tab includes tapered sides which converge to a point 23 at the top of the tab.

Figure 5:
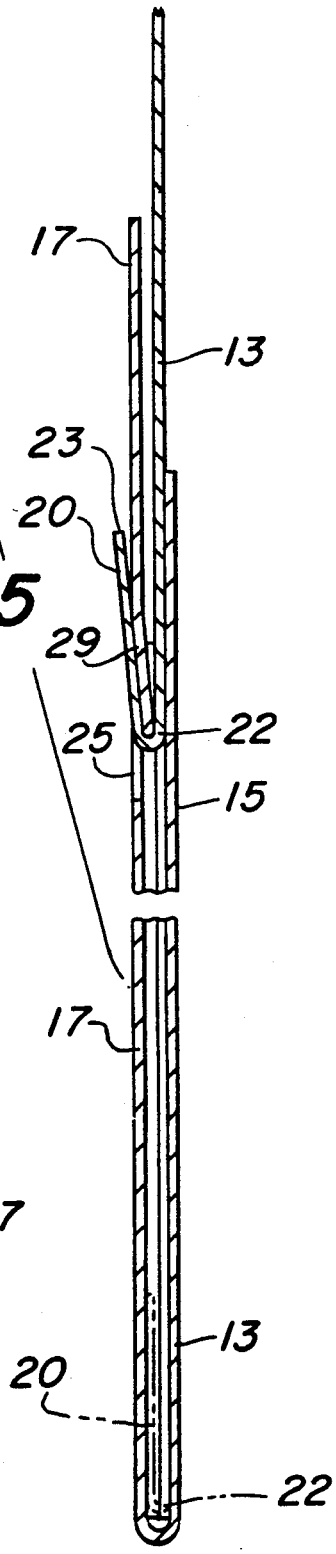
FIG. 5 is a cross-section taken from FIG. 2 showing two positions of the pullout, fully inserted, and the pullout fully extended.

Referring now to FIG. 5, side sectional views showing the pullout in the two extremes of its assembled condition are shown. At the bottom of FIG. 5, the fully inserted pullout is shown in phantom lines with the main portion of the pullout 13 and tab 20 compressed together at the bottom of the envelope. The upper part of FIG. 5 shows the pullout 13 moved upward until tang 29 interlocks with the crease of reverse fold 22. It will be readily understood by those in the mechanical arts that as pullout 13 is moved upward, tab 20 is forced against the inside of the envelope by the spring force created at the reverse fold 22 by the inherent resilience of its material. As the pullout progresses upward, the tip 23 of tab 20 passes window 25 and at that point is pushed out of the envelope. As it proceeds upward, the tip 23 catches the end of tang 29. As the pullout proceeds even farther upward, the end of tang 29 bottoms against fold crease 22 at the point of pullout's farthest extension. A unique benefit of this construction is that greater force exerted on the pullout after the tang 29 is fully engaged with the reverse fold 22 increases its interlocking strength to the envelope. This is caused by tang 29 being further forced inward as pullout 13 is pulled upward. This causes tang 29 to press more tightly against pullout 13 as more force is applied. Thus, an extremely strong interlock between the envelope and the pullout is achieved.

Referring now to FIG. 6, greater detail of the rear face of the envelope with the tab extending through the window portion in the rear face is shown. After the tab 20 catches the tang, it slides up through the side cuts 28 of the tang. It will be readily understood by these mechanical relations that as this interlock is achieved, the tab becomes wedged within the side cuts 28 between the tang and the rear face of the envelope. With the pullout fully extended as shown in this position, this wedging effect creates a frictional engagement between the pullout and the envelope which holds it in its extended position from falling back down into the envelope. This is yet one more advantage of the present invention which is not achievable with any other construction known in the art.

An added benefit of the construction of the present invention is that the folded pullout may be inserted directly into the envelope in one straight motion without additional bending or manipulation of the tab required. Thereafter, the tab becomes self-locking each time the pullout is pulled up when the tip of the tab passes the window and engages the tang. In order to release the pullout from the envelope, the operator of the card need merely extend the pullout to the point where the tip 23 of tab 20 passes window 25. Then, by pressing back tip 23 against the inside of the envelope with a finger, the operator can slide the tab past the window and continue to move the pullout completely out of the envelope without destruction to either part. Thereafter the pullout can be reinserted and interlock re-established at will.

It should be understood that the above description discloses specific embodiments of the present invention and are for purposes of illustration only. For example, the card construction disclosed herein is not limited to greeting cards, but may also be applicable to calorie counters, calendars, numeric conversion charts, telephone number listings and many other possible uses where it is desired to access and display information. There may be other modifications and changes obvious to those of ordinary skill in the art which fall within the scope of the present invention which should be limited only by the following claims and their legal equivalents.

What is claimed is:

1. A movable card construction, comprising:

(a) an envelope in the form of a pocket having a front face, a rear face, and an opening at the top;

(b) a pullout card located slideably within said envelope and movable so that it projects at the top from said opening;

(c) a tab extending from the bottom of said pullout card formed by a reverse fold at the bottom of said pullout card; and (d) a window in the rear face of said envelope, said window engaging said tab and stopping the movement of said pullout card only as the pullout card is moved upward.

2. The card of claim 1 wherein said tab includes tapered sides which converge in the upward direction to a tip at a top end opposite said reverse fold.

3. The card of claim 2 wherein said window includes a deflectable tang projecting downward from a fold line at the top of said window, whereby said tang is displaced inward toward the front face of said envelope as it engages said tab.

4. The card of claim 3 wherein said tang is formed in the rear face of said envelope.

5. The card of claim 4 wherein the free distance between the tip of said tab and said pullout is substantially greater than the inside width of said envelope, thus providing an outward spring force of said tab against the inside of the rear face of said envelope.

6. The card of claim 5 wherein said pullout is released from said envelope by depressing said tab inward against said pullout and sliding said pullout past the tang.

7. The card of claim 6 further including side cuts in the rear face of said envelope located on either side of said tang whereby said tab is forced into and frictionally engages said side cuts when said pullout is moved to its uppermost position.

8. The card of claim 7 wherein said pullout includes an amusing message or informative indicia.

* * * * *